United States Patent [19]

Love

[11] 4,450,827

[45] May 29, 1984

[54] ANDIRON MOUNTING SYSTEM

[76] Inventor: Samuel D. Love, 13520 Old Indian Head Rd., Brandywine, Md. 20613

[21] Appl. No.: 351,368

[22] Filed: Feb. 23, 1982

Related U.S. Application Data

[63] Continuation-in-part of Ser. No. 274,268, Jun. 16, 1981, abandoned.

[51] Int. Cl.[3] ..... F24B 13/00

[52] U.S. Cl. ..... 126/298; 126/336

[58] Field of Search ..... 126/298, 336, 201, 203, 126/152 B, 152 R; D7/211; 16/236, 221, 2, DIG. 39; 308/239

[56] References Cited

U.S. PATENT DOCUMENTS 9,825 7/1836 Cochran ..... 126/298

871,266 11/1907 Gertenbach ..... 126/153

2,569,198 9/1951 Schoenheit ..... 126/298

*Primary Examiner*—Samuel Scott

*Assistant Examiner*—G. Anderson

*Attorney, Agent, or Firm*—Parkhurst & Oliff

[57] ABSTRACT

An andiron mounting system whereby an andiron is directly and swivelably connected to a fireplace grate. A connecting member is attached to the andiron at one end and has an aperture with a bushing at the other end. The bushing extends beyond the vertical extents of the aperture in the connecting member. A bolt extends through apertured mounting plates which contact the fireplace grate and also extends through the bushing. The connecting member may be bent twice to provide height adjustability.

16 Claims, 5 Drawing Figures

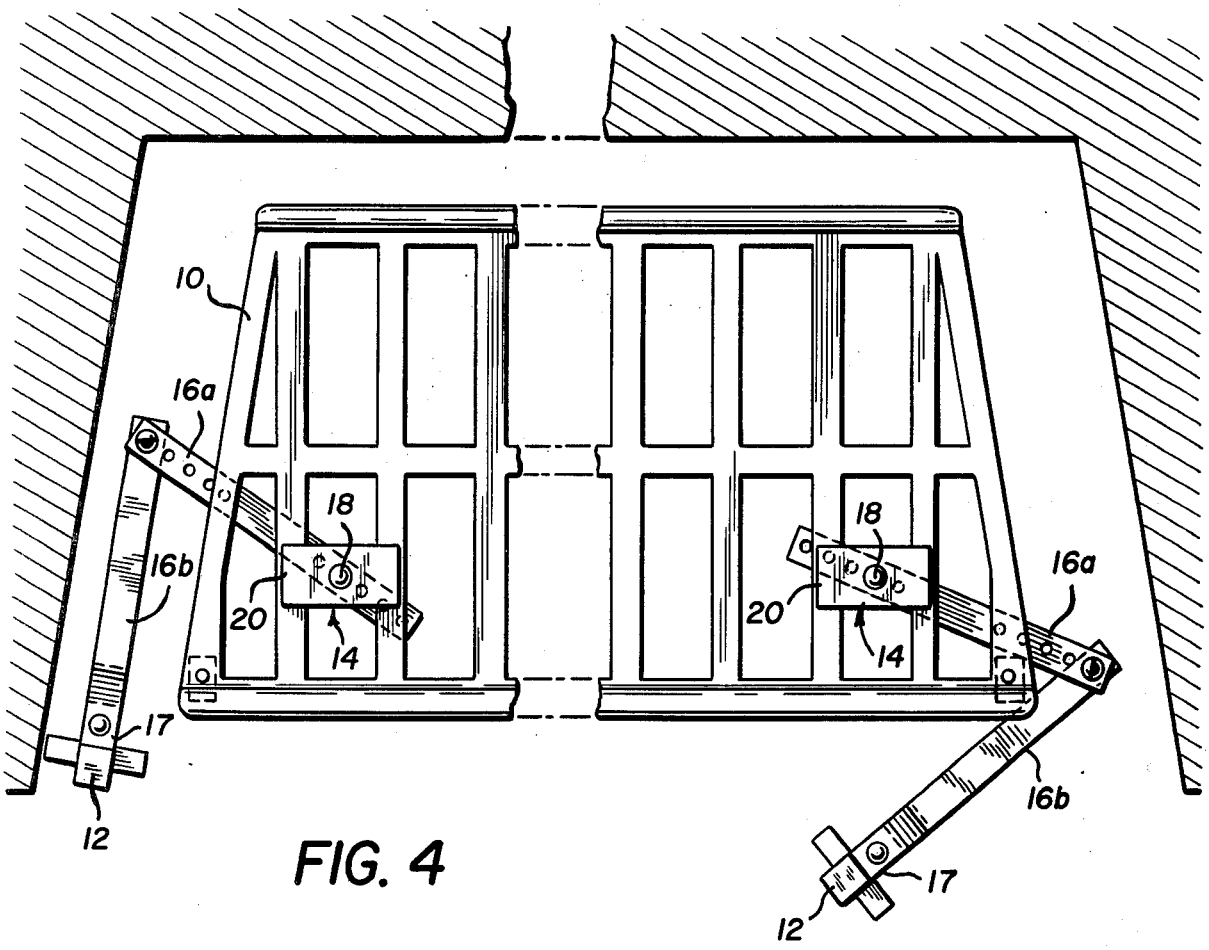
FIG. 4
FIG. 5
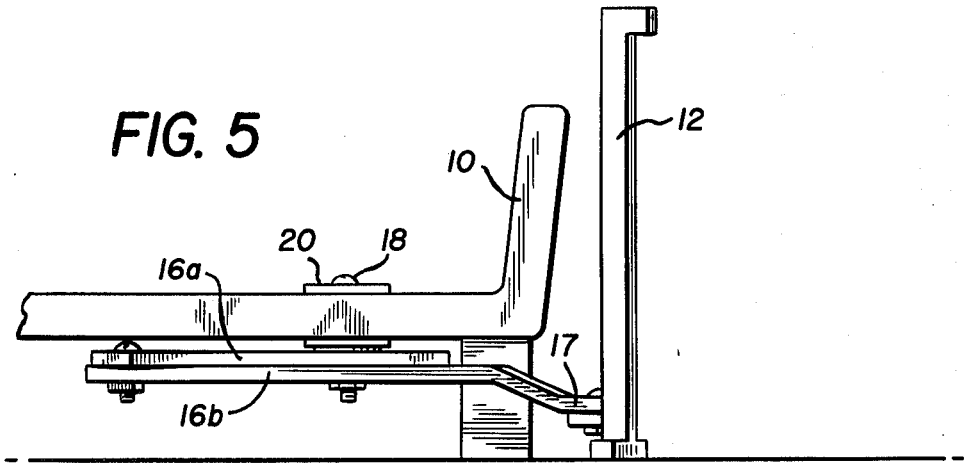

ANDIRON MOUNTING SYSTEM

CROSS REFERENCE TO RELATED APPLICATIONS

This application is a continuation-in-part of U.S. Application Ser. No. 274,268, filed June 16, 1981, now abandoned.

BACKGROUND OF THE INVENTION

1. Field of the Invention

This invention relates to a device for attaching an andiron directly to a fireplace grate, and more particularly, to a device for swivelably mounting an andiron to a fireplace grate.

2. Description of the Prior Art

In the past, andirons have been situated in a fireplace and supported by legs which extend underneath the fireplace grate. As a result, the andirons have been difficult to move to allow for refueling of the fireplace grate, especially when the andiron legs have extended through holes in a fireplace screen. The legs of the andiron have cluttered the area beneath the fireplace grate, making it difficult to use a draft control or other device underneath the fireplace grate, and also making cleaning of the hearth area difficult.

SUMMARY OF THE INVENTION

It is an object of this invention to provide a mounting system for andirons whereby the andirons are mounted directly to a fireplace grate.

It is a further object of this invention to provide an andiron mounting system whereby the andirons may be placed any desired distance from the fireplace grate.

It is a still further object of this invention to provide an andiron mounting system wherein the andirons may be pivoted or swiveled so as to provide clear and easy access to the fireplace grate.

It is a still further object of this invention to provide an andiron mounting system which is of simple and economical manufacture, and which is easily adaptable to presently existing fireplace grates.

The above objects and others are obtained by providing an andiron mounting system wherein a connecting member, which is attached to the andiron, is directly mounted to the fireplace grate. The connecting member is mounted by means of a bolt which extends through a bushing located in an aperture in the connecting member, and extends through a slot in the fireplace grate by means of apertured mounting plates.

BRIEF DESCRIPTION OF THE DRAWINGS

FIG. 4 is a top view of an alternative embodiment of the present invention; and FIG. 5 is a side view of the device of FIG. 4.

DESCRIPTION OF A PREFERRED EMBODIMENT

Figure 1:
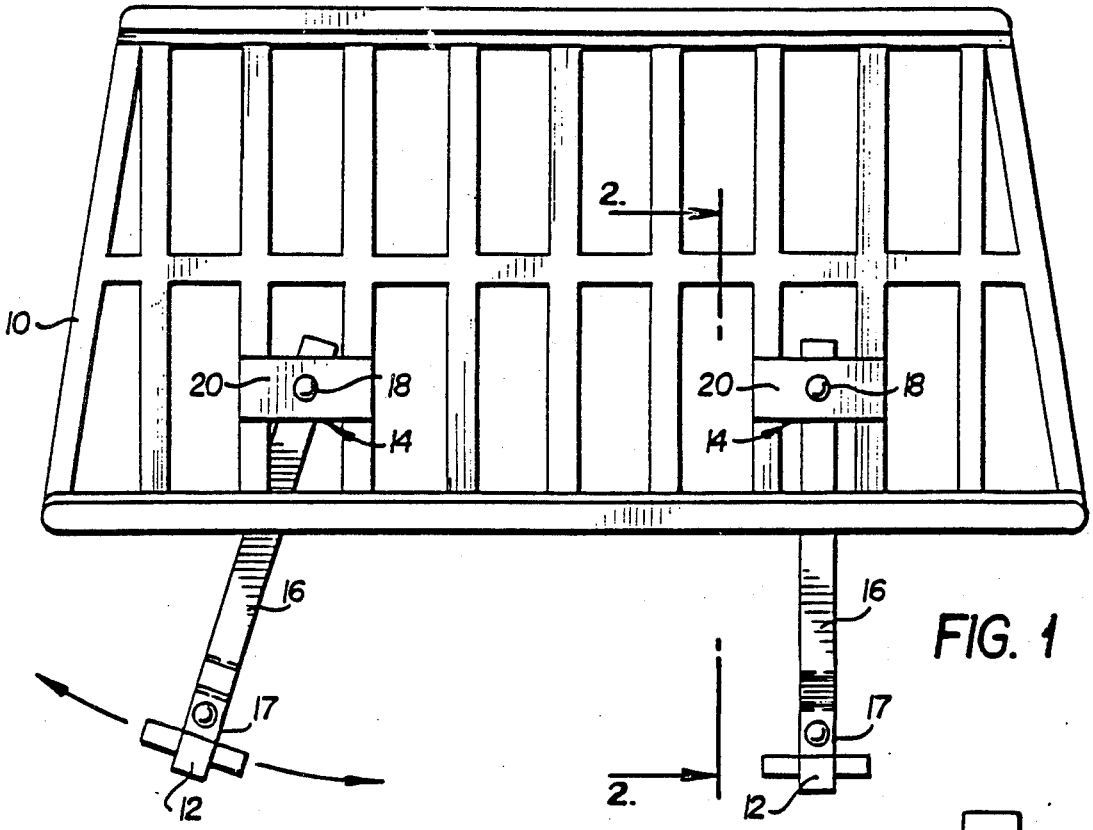
FIG. 1 is a top view of a fireplace grate with andiron mounting system of the present invention.

Referring to the drawings, there is shown a fireplace grate 10, andirons 12, mounting system 14 and connecting member 16. The connecting member 16 is attached to the andiron 12 by means of connector 17, which is preferably a nut and bolt assembly. Of course, other connectors could be used, or the andiron and connecting member could be formed as a single unit if so desired.

Figure 2:
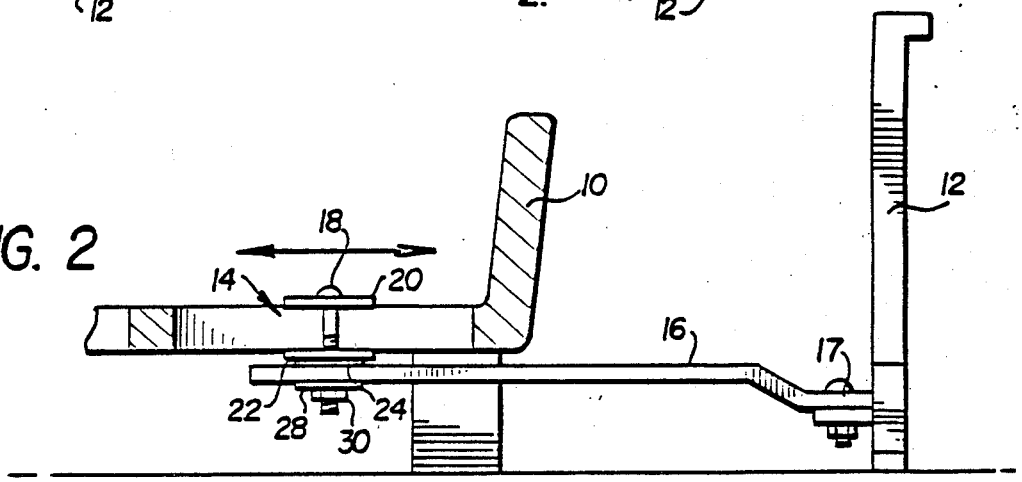
FIG. 2 is a sectional side view taken along line 2—2 of FIG. 1.
Figure 3:
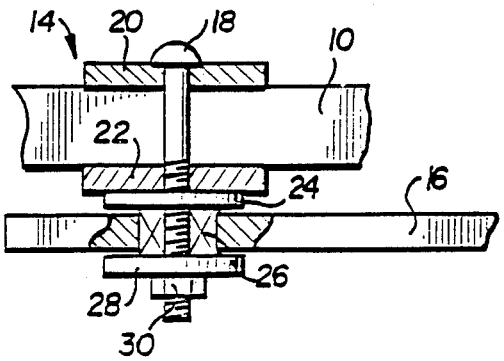
FIG. 3 is an enlarged sectional view of the mounting of the andiron connecting member to the fireplace grate.

Referring more specifically now to FIGS. 2 and 3, connecting member 16 is attached to the grate 10 by means of the mounting system 14. Bolt 18 extends through one of the openings or slots normally provided in a fireplace grate, and also extends through apertures provided in upper mounting plate 20 and lower mounting plate 22. Upper plate 20 contacts the top of the grate and lower plate 22 contacts the bottom of the grate. Although two mounting plates are preferred, it is clear that one or both of the mounting plates could be eliminated, depending upon the specific design utilized. A first washer 24 is located beneath the lower mounting plate 22. Next is the connecting member 16, which is provided with an aperture and a bushing 26 which extends beyond the vertical extents of the aperture in the connecting member. Finally, there is provided a second washer 28 and a nut 30 to tightly hold the mounting system together.

It should be noted that the connecting member 16 is provided with a double bend in the preferred embodiment. This allows for encompassing a variety of andirons having their places of attachment located at different vertical heights. By simply turning the connecting member upside down, the apparatus shown in FIG. 2 could be adapted for andirons having their place of connection situated at a higher vertical location. Minor adjustments in height may be made by providing a plurality of washers 24. Bolt 18 is preferably a carriage bolt, which is preferred because the large head of the carriage bolt can help protect the mounting system from soot, ashes and other fireplace grate debris. A gasket system could also be used with or instead of the large headed carriage bolt, if so desired.

The provision of bushing 26, which extends beyond the vertical extents of the aperture in the connecting member 16, allows for the andiron 12 and connecting member 16 to be swivelably rotated, thus allowing for easy access to the fireplace grate. It should also be noted that the mounting system 14 can be attached to any of the slots provided in the fireplace grate, allowing the user great latitude in the positioning of the andirons. Also, the mounting system 14 may be attached at any point along the length of one of the slots, allowing the andirons to be positioned at any desired distance from the front of the fireplace grate. Since the rear legs of the andiron support are thus eliminated by the present invention, the space underneath the fireplace grate is relatively clear, also allowing for easier cleaning of the fireplace hearth.

In the alternative embodiment of FIGS. 4 and 5, connecting member 16 is made up of two parts, **16*a* and 16*b*. Part 16*a* is swivelably mounted to the grate in the same manner as connecting member 16 in FIGS. 1–3. Andiron 12 is connected to part 16*b* also in the same manner as in FIGS. 1–3**.

Part **16*a* is preferably provided with a plurality of connecting holes. The plurality of holes for carriage bolt 18 allows variations in the outward extent of part 16*a*. The plurality of holes where part 16*b* is attached allows variations in the final position of andiron 12. A plurality of holes could also be provided in part 16*b***.

Parts 16a and 16b should be tightly bolted together to prevent relative movement between them. Thus, when part 16a abuts the back of the grate leg, the andiron cannot be moved outwardly, by something like a falling log for example. Preferably both parts 16a and 16b abut the grate leg. Of course, part 16b should be adjusted to the proper position before it is completely secured to part 16a.

In FIG. 4, one andiron has been shown in position in front of the grate, while the other andiron is shown after being moved away from the front of the grate.

The swivelable mounting of part 16a allows the andirons to be moved out from the front of the grate when access to the grate is desired. In this second embodiment, the space beneath the front of the grate is open. Thus, if it is desired to put a baffle underneath the front of the grate to direct air to the grate, enough room is provided.

Although a preferred embodiment has been described, it should not be regarded as limiting the spirit and scope of the present invention, which is defined in the following claims.

What is claimed is:

1. An andiron mounting system, comprising:

an elongate connecting member having one end attachable to an andiron;

an attachment member for securing the other end of said connecting member to a fireplace grate at any one of a plurality of positions on said grate; and means for allowing said connecting member to swivel in relation to the fireplace grate.

2. An andiron mounting system as in claim 1, wherein the said other end of said connecting member is supported vertically by said grate at a point different from those points at which the grate is itself supported vertically.

3. An andiron mounting system comprising:

an elongate connecting member having one end attachable to an andiron;

an attachment member for securing the other end of said connecting member to a fireplace grate; and means for allowing said connecting member to swivel in relation to the fireplace grate;

wherein said means for swivelably connecting comprises a bushing extending vertically through a vertical aperture in said connecting member, having a length such that the ends of the bushing extend beyond the vertical extents of the aperture in the connecting member.

4. An andiron mounting system as claimed in claim 3, wherein said means for swivelably connecting further comprises an apertured mounting plate for contacting a fireplace grate, and a bolt extending through the mounting plate aperture and the bushing.

5. An andiron mounting system as claimed in claim 3, wherein said means for swivelably connecting further comprises a first apertured mounting plate for contacting a grate top, a second apertured mounting plate for contacting a grate bottom, and a bolt extending through the apertures of the first and second mounting plates and the bushing.

6. An andiron mounting system as claimed in claim 5, further comprising a first washer disposed immediately above said bushing and a second washer disposed immediately below said bushing.

7. An andiron mounting system as claimed in any one of claims 3 through 6 wherein said connecting member is a twice bent elongate member.

8. An andiron mounting system as claimed in any one of claims 4 through 6 wherein said bolt is a carriage bolt.

9. An andiron mounting system, comprising:

an andiron;

an elongate connecting member having one end connected to said andiron;

an attachment member for securing the other end of said connecting member to a fireplace grate at any one of a plurality of positions on said grate; and means for allowing said connecting member to swivel in relation to the fireplace grate.

10. An andiron mounting systems as in claim 9, wherein the said other end of said connecting member is supported vertically by said grate at a point different from those points at which the grate is itself supported vertically.

11. An andiron mounting system as in claim 9, wherein the connecting member is a two bar linkage having one end of the first bar attached to the andiron, and one end of the second bar connected to said attachment member.

12. An andiron mounting system, comprising:

an elongate connecting member comprising a two bar linkage having first and second bars, one end of said second bar having means for attachment to an andiron;

an attachment member for securing one end of said first bar to a fireplace grate at any one of a plurality of positions on said grate; and means for allowing said first bar to swivel with respect to the fireplace grate.

13. An andiron mounting system as in claim 12, wherein means are provided for adjusting the length of at least one bar of the two bar linkage.

14. An andiron mounting system, comprising:

an elongate connecting member comprising a two bar linkage having first and second bars, said second bar having means for attachment to an andiron;

an attachment member for securing one end of said first bar to a fireplace grate; and means for allowing said first bar to swivel with respect to the fireplace grate;

wherein said means for swivelably mounting comprises a bushing extending vertically through a vertical aperture in said first bar, having a length so that each end of the bushing extends beyond the vertical limits of the first bar.

15. An andiron mounting system as claimed in claim 12 or 14, comprising means for non-movably connecting said first and second bars.

16. An andiron mounting system as claimed in claim 15, wherein said first bar is an elongate member provided with a plurality of vertically extending apertures at each end of the first part.

* * * * *